United States Patent [19]

Matsudaira et al.

[11] Patent Number: 4,627,800

[45] Date of Patent: Dec. 9, 1986

[54] SCROLL TYPE FLUID DISPLACEMENT COMPRESSOR WITH SPIRAL WRAP ELEMENTS OF VARYING THICKNESS

[75] Inventors: Yasuyuki Matsudaira, Isesaki; Masaharu Hiraga, Honjo, both of Japan

[73] Assignee: Sanden Corporation, Gunma, Japan

[21] Appl. No.: 697,747

[22] Filed: Feb. 4, 1985

[51] Int. Cl.[4] ..... F04C 18/04

[52] U.S. Cl. ..... 418/55

[58] Field of Search ..... 418/55, 59, 150

[56] References Cited

U.S. PATENT DOCUMENTS

| | | | |
|---|---|---|---|
| 801,182 | 10/1905 | Creux | 418/55 |
| 2,324,168 | 7/1943 | Montelius | 418/55 |
| 3,874,827 | 4/1975 | Young | 418/55 |
| 4,382,754 | 5/1983 | Shaffer et al. | 418/55 |

*Primary Examiner*—John J. Vrablik

*Attorney, Agent, or Firm*—Banner, Birch, McKie & Beckett

[57] ABSTRACT

A scroll type fluid displacement apparatus is disclosed which includes a pair of scrolls each having a circular end plate and spiral element extending therefrom. The scrolls are maintained at an angular and radial offset so that both spiral elements interfit to form a plurality of line contacts to define at least one pair of sealed off fluid pockets. Upon relative orbital motion of the scrolls, the line contacts shift along the spiral curved surfaces of the spiral elements to thereby change the volume of the fluid pockets. In particular, according to the present invention, the thickness of the spiral element of the orbiting scroll is gradually from the inner end of the spiral element to its outer end to increase the mechanical strength of the spiral element at its central portion while avoiding an increase in the centrifugal force generated by the orbiting scroll during orbital motion. On the other hand, the thickness of the spiral element of the other scroll, i.e., the fixed scroll, is gradually increased from the inner end of the spiral element to its outer end to compensate for the change in shape of the facing spiral element of the orbiting scroll.

2 Claims, 9 Drawing Figures

SCROLL TYPE FLUID DISPLACEMENT COMPRESSOR WITH SPIRAL WRAP ELEMENTS OF VARYING THICKNESS

BACKGROUND OF THE INVENTION

This invention relates to a fluid displacement apparatus, and more particularly, to a scroll type fluid displacement apparatus with improved spiral elements.

Scroll type fluid displacement apparatus are well known in the prior art. For example, U.S. Pat. No. 801,182 issued to Creux discloses the basic construction of a scroll type fluid displacement apparatus which comprises a pair of scrolls each having a circular end plate and a spiroidal or involute spiral element. The scrolls are maintained angularly and radially offset so that both spiral elements interfit to form a plurality of line contacts between their spiral curved surfaces to thereby seal off and define at least one pair of fluid pockets. The relative orbital motion of the two scrolls shifts the line contacts along the spiral curved surfaces and, as a result, changes the volume of the fluid between the spiral elements. Thus, scroll type fluid displacement apparatus may be used to compress, expand or pump fluids.

Scroll type fluid displacement apparatus are suitable for use as refrigerant compressors. In scroll type refrigerant compressors, refrigerant gas generally is taken into fluid pockets formed at the outer most end portion of the spiral elements. The fluid pockets are gradually compressed as these fluid pockets are moved toward the center of the spiral elements due to the orbital motion of the orbiting scroll. Finally, when compressed fluid reaches the central portion of the interfitting spiral elements, the compressed fluid is discharged to an external fluid circuit. As a consequence of the above operation, the temperature and pressure of the refrigerant gas are maximized in the central portion of the interfitting spiral elements.

In prior art scroll type compressors, the spiral elements generally have a uniform thickness, i.e., the thickness of the spiral elements from the inner end portion to the outer end portion is the same. In the past, when the thickness of the spiral element, particularly the central portion of the spiral element, was increased to achieve sufficient mechanical strength, the thickness of the entire spiral element from the inner end portion to the outer end portion was likewise increased. As a result, the weight of the scrolls increased, and the centrifugal force generated by the orbital motion of the orbiting scroll increased. This increase in the centrifugal force of the orbiting scroll has caused several problems, such as excessive wearing of the scrolls and other damage to the scrolls and the scroll type refrigerant compressor.

SUMMARY OF THE INVENTION

It is a primary object of this invention to provide an improved scroll type fluid displacement apparatus in which the mechanical strength of the spiral elements of the scrolls is improved without increasing the weight.

It is another object of this invention to provide a scroll type fluid displacement apparatus which accomplishes the above object while employing a simple construction.

A scroll type fluid compressor according to this invention includes a pair of scrolls each having a circular end plate and a spiral wrap extending from the circular end plate. Both scrolls are maintained at an angular and radial offset so that the spiral wraps interfit to form a plurality of line contacts to define at least one pair of sealed off fluid pockets. A driving mechanism is operatively connected to one scroll, i.e., the orbiting scroll, to effect orbital motion of the orbiting scroll. A rotation prevention mechanism also is connected to the orbiting scroll to prevent rotation of the orbiting scroll so that the volume of the fluid pockets between the spiral elements of the scrolls is compressed during orbital motion. In particular, according to the present invention, the thickness of the spiral element of the orbiting scroll is gradually reduced from the inner end of the spiral element to its outer end to increase the mechanical strength of the spiral element at its central portion while avoiding an increase in the centrifugal force generated by the orbiting scroll during orbital motion. On the other hand, the thickness of the spiral element of the other scroll. i.e., the fixed scroll, is gradually increased from the inner end of the spiral element to its outer end to compensate for the change in shape of the facing spiral element of the orbiting scroll.

Further objects, features and other aspects of this invention will be better understood from the following detailed description of the preferred embodiment of this invention with reference to the annexed drawings.

BRIEF DESCRIPTION OF THE DRAWINGS

FIG. 2(*b*) is a sectional view taken along line II—II in FIG. 2(*a*).

FIG. 4(*b*) is a sectional view taken along line IV—IV in FIG. 4(*a*).

FIG. 6(*b*) is a sectional view taken along line IV—IV in FIG. 6(*a*).

DETAILED DESCRIPTION OF THE PREFERRED EMBODIMENT

Figure 1:
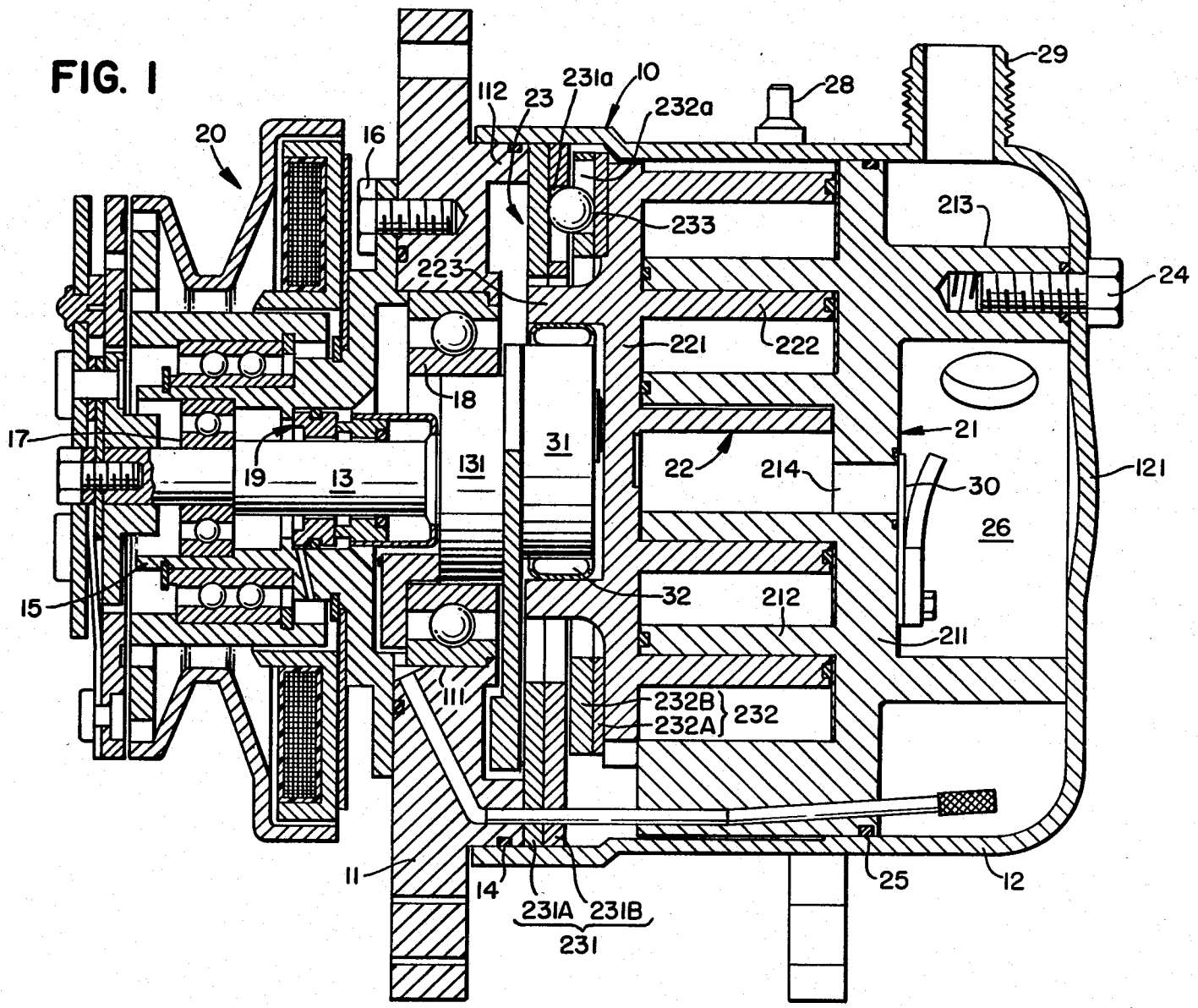
FIG. 1 is a vertical sectional view of a refrigerant compressor in accordance with one embodiment of this invention.

Referring to FIG. 1, refrigerant compressor 1 includes compressor housing 10 including cup-shaped casing 12 and front end plate 11 attached thereto. Opening 111 is formed in the center of front end plate 11 for drive shaft 13. Annular projection 112, concentric with opening 111, is formed on the inside surface of front end plate 11 and projects inside cup shaped casing 12 to cover cup-shaped casing 12. O-ring 14 is placed between the outer peripheral surface of annular projection 112 and the inner surface of cup-shaped casing 12 to seal the mating surfaces of front end plate 11 and cup-shaped casing 12. Front end plate 11 has an annular sleeve 15 which projects from the front end surface thereof; annular sleeve 15 surrounds drive shaft 13 and defines a shaft seal cavity. In the embodiment shown in FIG. 1, annular sleeve 15 is formed separately from the front end plate 11; annular sleeve 15 is fixed to the front end surface of front end plate 11 by a fastening device such as screws 16. Alternately, annular sleeve 15 may be formed integral with front end plate 11.

Drive shaft 13 is rotatably supported by annular sleeve 15 through bearing 17 disposed within the front end portion of annular sleeve 15. Drive shaft 13 has a disk shaped portion 131 at its inner end portion which is rotatably supported by front end plate 11 through bearing 18 disposed within opening 111 of front end plate 11. Shaft seal assembly 19 is assembled on drive shaft 13 within the shaft seal cavity.

Drive shaft 13 is coupled to electromagnetic clutch 20 which is disposed on the outer peripheral portion of annular sleeve 15. Drive shaft 13 is driven by an external power source (e.g., the motor of an automobile) through electromagnetic clutch 20.

A number of elements are located within an inner chamber of housing 10 including fixed scroll 21, orbiting scroll 22, a driving mechanism for orbiting scroll 22 and rotation prevention/thrust bearing device 23 for orbiting scroll 22. The inner chamber of housing 10 is defined between the inner surface of cup-shaped casing 12 and the inner end surface of front end plate 11.

Fixed scroll 21 has a circular end plate 211 and a wrap or involute spiral element 212 affixed to or extending from a side surface of circular end plate 211. Circular end plate 211 includes internal threaded bosses 213 axially projecting from its outer side surface. An axial end surface of each boss 213 fits against the inner surface of bottom end plate 121; circular end plate 211 is fixed by screws 24 screwed into bosses 213 from outside bottom end plate 121. Seal element 25 is disposed in a circumferential groove formed on the outer peripheral surface of circular end plate 211 so that the inner chamber of housing 10 is partitioned into rear chamber 26 disposed between bosses 213 of fixed scroll 21 and front chamber 27 in which spiral element 212 of fixed scroll 21 is disposed.

Cup-shaped casing 12 is provided with fluid inlet port 28 and fluid outlet port 29, which are connected to rear and front chamber 26 and 27, respectively. A hole or discharge port 214 is formed through circular end plate 211 at a position near the center of spiral element 212; discharge port 214 connects rear chamber 26 and the central fluid pocket located between the spiral elements of fixed scroll 21 and orbiting scroll 22. Reed valve 30 closes discharge port 214.

Orbiting scroll 22, which is located in front chamber 26, has a circular end plate 221 and a wrap or involute spiral element 222 affixed to or extending from a side surface of circular end plate 221. Both spiral elements 212 and 222 interfit at an angular offset of 180° and a predetermined radial offset. At least one pair of fluid pockets is defined between spiral elements 212, 222. Orbiting scroll 22 is rotatably supported on bushing 31 through bearing 32 placed between the outer peripheral surface of bushing 31 and an inner surface of annular boss 223 axially projecting from the rear surface of the end plate 221. Bushing 31 is connected to an inner end of disk shaped portion 131 at a point radially offset or eccentric from the axis of drive shaft 13. Thus, orbiting scroll 22 undergoes orbital motion upon rotation of drive shaft 13.

Rotation prevention/thrust bearing device 23 is placed between the inner end surface of front end plate 11 and the end surface of circular end plate 221. Rotation prevention/thrust bearing device 23 includes fixed ring 213 attached to the inner end surface of annular projection 112 of front end plate 11, orbiting ring 232 attached to the end surface of circular end plate 221 and a plurality of bearing elements, such as balls 233, placed between pockets 231*a*, 232*a* formed on both rings, 231, 232. In the embodiment shown in FIG. 1, each ring 231, 232 includes race plate 231A, 232A and ring plate 231B, 232B. Alternatively, the race plate and ring plate can be formed integral with one another. Rotation of orbiting scroll 22 during orbital motion is prevented by the interaction of balls 233 with rings 231, 232. The axial load from orbiting scroll 22 also is supported on front end plate 11 through balls 233.

During operation of the refrigerant compressor, refrigerant fluid flows into front chambers 27 through fluid inlet port 28 and into the fluid pockets formed in the open spaces between the outer end portion of one of spiral elements 212, 222 and the outer wall surface of the other spiral element. As orbiting scroll 22 orbits, these fluid pockets move toward the central portion of the spiral elements with consequent reduction in volume and compression of the refrigerant fluid. The compressed fluid is discharged into rear chamber 26 from the central fluid pocket through discharge port 214. The fluid then is discharged to the external fluid circuit through fluid outlet port 29.

Figure 2A:
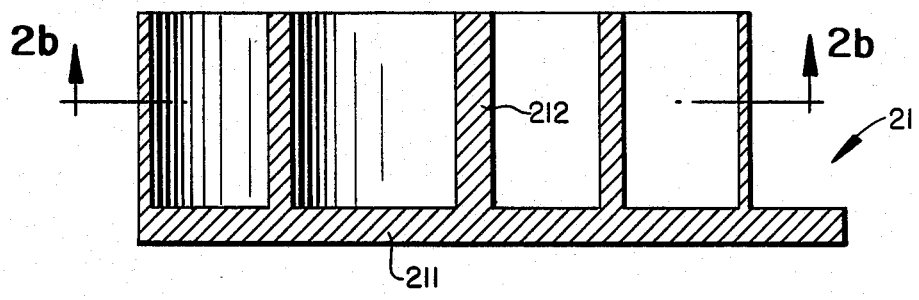
FIG. 2(*a*) is a sectional view of an oribiting scroll used in FIG. 1.
Figure 2B:
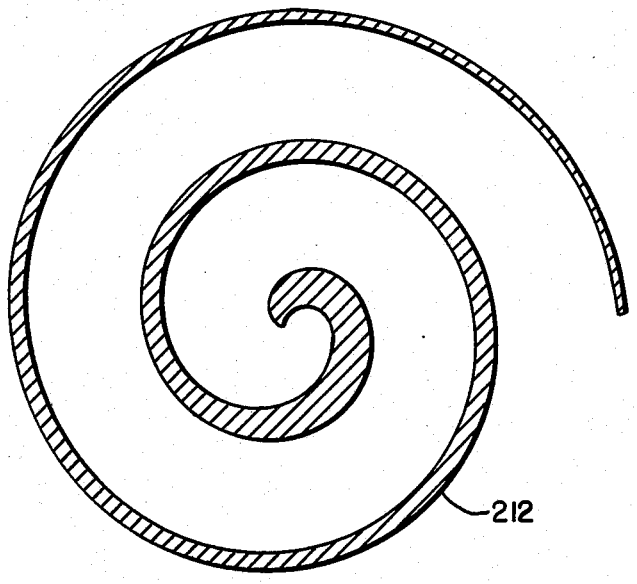
Figure 3:
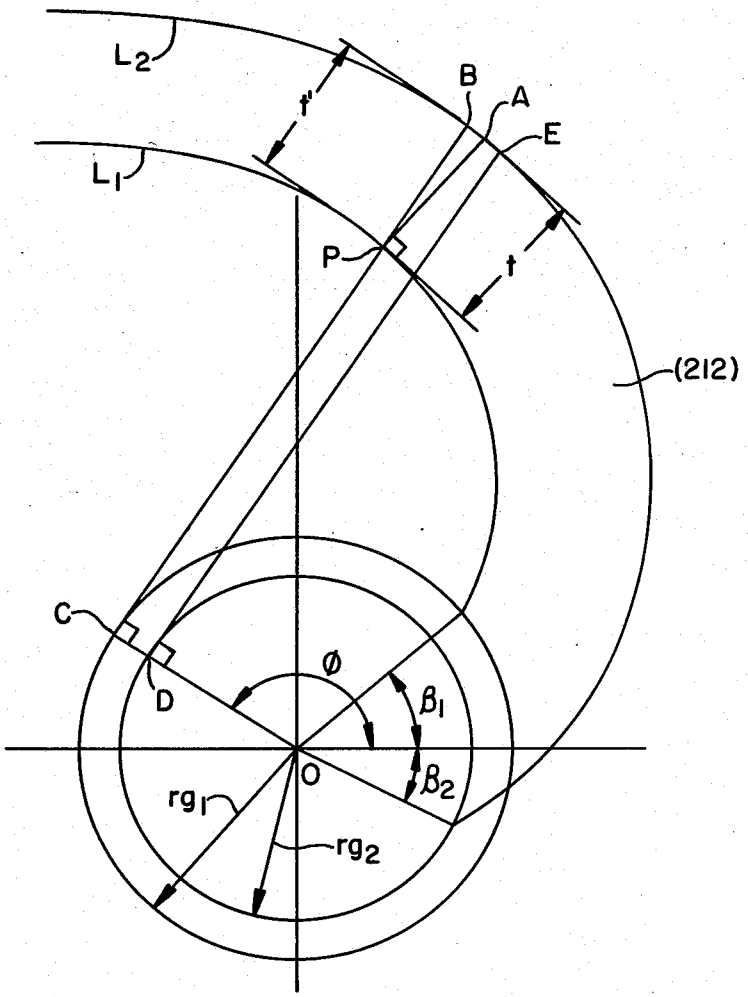
FIG. 3 is a diagramatic view illustrating the basic properties of an involute spiral wrap of the orbiting scroll shown in FIG. 2.

Referring to FIGS. 2 and 3, the configuration of the spiral element of the orbiting scroll now will be described in greater detail. As shown, the thickness of spiral element 222 is gradually reduced toward its outer end portion. The inner wall surface of spiral element 222 is formed by involute curve $L_1$ which starts at a point on a generating circle at angular offset $\beta_1$ from the horizontal plane. The generating circle of involute curve $L_1$ has radius $rg_1$. The outer wall surface of spiral element 222 is formed by involute curve $L_2$ which starts at a point on a generating circle at angular offset $\beta 2$ from the horizontal plane. The generating circle of involute curve $L_2$ has radius $rg_2$ which is smaller than radius $rg_1$. In this arrangement, the thickness "t" of the spiral element is generally defined by the distance between the intersection points P, B of involute curves $L_1$ and $L_2$ with the tangent of the generating circle at point C. However, since this invention provides two involute curves generated from different generating circles, the true thickness "t" is actually defined along line PA perpendicular to the tangent through intersection P. But the difference between thickness "t" and "t'" is very small so that these thicknesses are approximately the same ($t \approx t'$); also, the lengths $\overline{CB}$ and $\overline{De}$ are approximately the same. Therefore, the thickness at point P is given by the following equation:

$$t = rg_2(\phi + \beta_2) - rg_1(\phi - \beta_1)$$
$$= (rg_2 - rg_1)\phi + (rg_2\beta_2 - rg_1\beta_1)$$

Furthermore, the rate of change of thickness "t" can be determined from the above equation by taking the derivative of "t" with respect to angle $\phi$. Since the radius $rg_1$ of the generating circle for the inner wall of the spiral element is larger than radius $rg_2$ of the generating circle for the outer wall, the rate of change of thickness ($dt/d\phi$) is negative.

As mentioned previously, because the thickness of the spiral element of the orbiting scroll is gradually reduced from the inner end portion of the outer end portion, the total weight of the orbiting scroll is reduced. At the same time, the mechanical strength of the spiral element at its central portion, where temperature and pressure are the greatest, is increased. Thus, the mechanical strength of the orbiting scroll of the present invention is improved while the centrifugal force generated by orbital motion of the orbiting scroll 22 is reduced.

Figure 5:
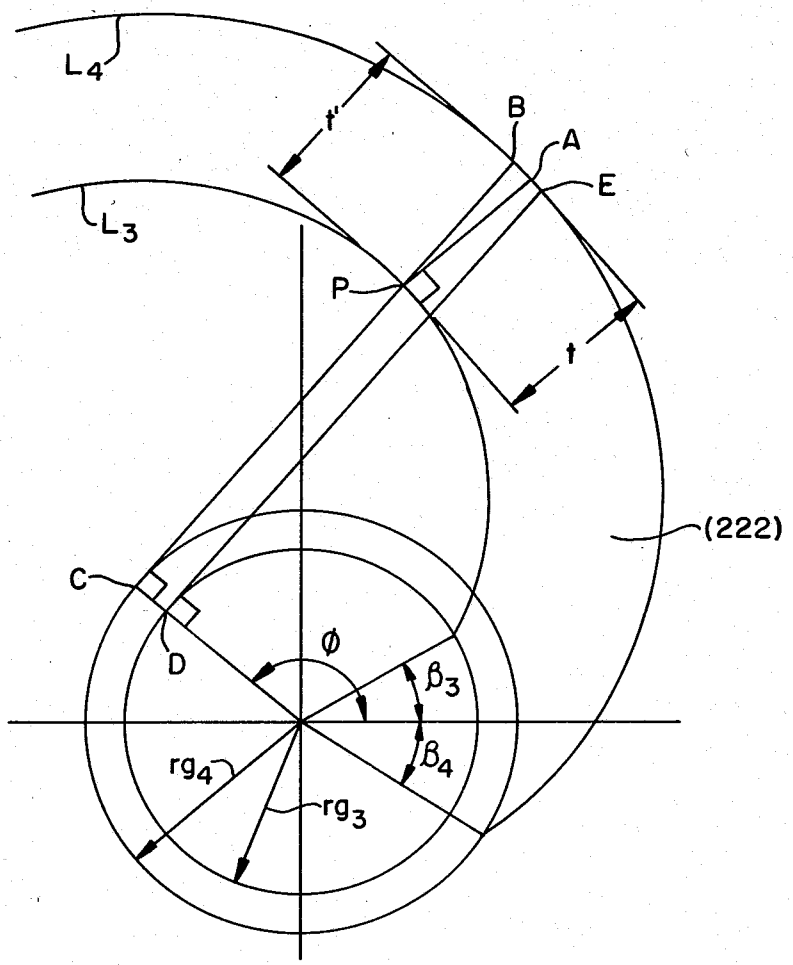
FIG. 5 is a diagramatic view illustrating the basic properties of an involute spiral wrap of the fixed scroll shown in FIG. 4.
Figure 4A:
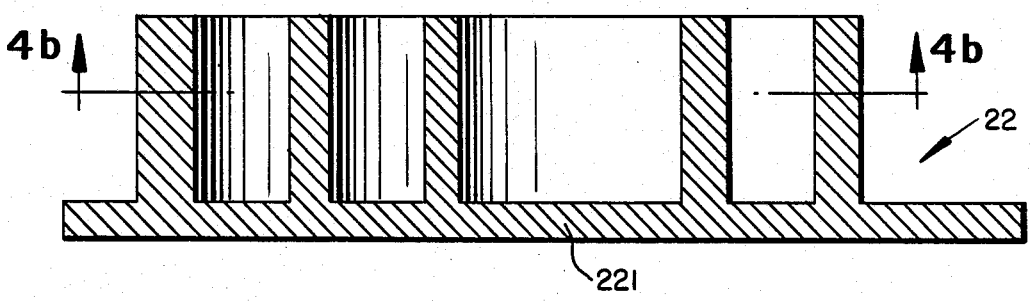
FIG. 4(*a*) is a sectional view of a fixed scroll used in FIG. 1.
Figure 4B:
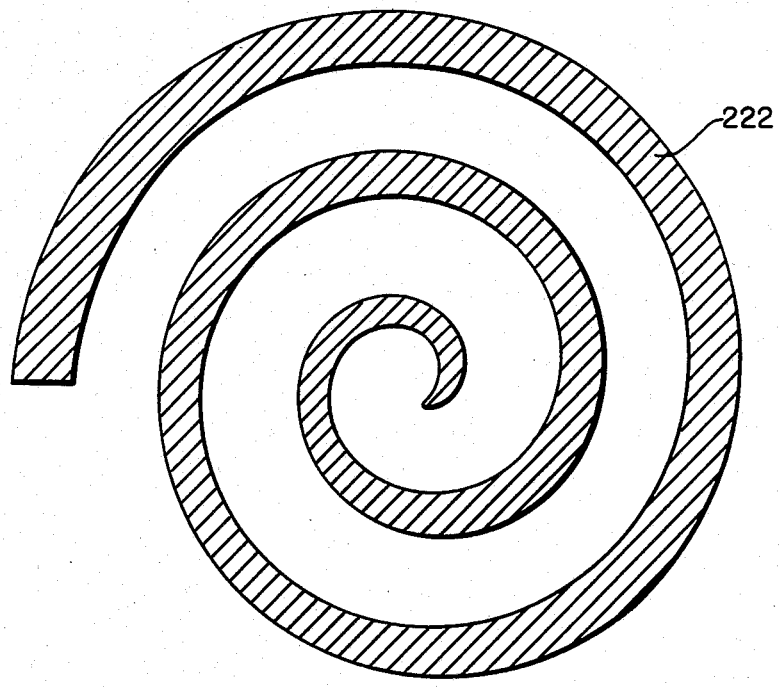

On the other hand, the thickness of spiral element 212 of fixed scroll 21 is gradually increased from its inner end portion to its outer end portion to compensate for the reduction in thickness of the facing spiral element of the orbiting scroll as shown in FIG. 4. With reference to FIG. 5, the inner wall surface of spiral element 212 of fixed scroll 21 is formed by involute curve $L_3$ which starts at a point on a generating circle at angular offset $\beta 3$ from the horizontal plane. The generating circle of involute curve $L_3$ has radius $rg_3$. The outer wall curve of spiral element 212 is formed by involute curve $L_4$ which starts at a point on a generating circle at angular offset $\beta 4$ from the horizontal plane. The generating circle of involute curve $L_4$ has radius $rg_4$ which is larger than radius $rg_3$.

In the arrangement of fixed scroll 21, the thickness "t" at point P on involute curve $L_3$ is given by the following equations:

$$t = t' = rg_4(\phi + \beta_4) - rg_3(\phi - \beta_3)$$

$$= (rg_4 - rg_3)\phi + (rg_4\beta_4 - rg_3\beta_3)$$

In this case, because radius $rg_4$ of the generating circle for the outer wall of the spiral element is greater than radius $rg_3$ of the generating circle for the inner wall, the rate of change of thickness ($dt/t\phi$) is positive, i.e., the thickness of the spiral element of the fixed scroll increases from its inner end portion.

Figure 6B:
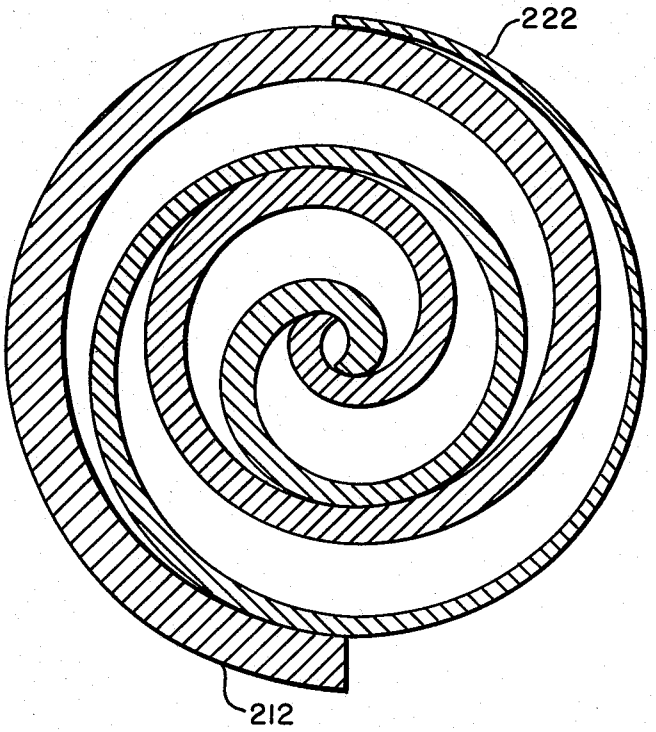
FIG. 6(*a*) is a vertical sectional view of interfitting orbiting and fixed scrolls.
Figure 6A:
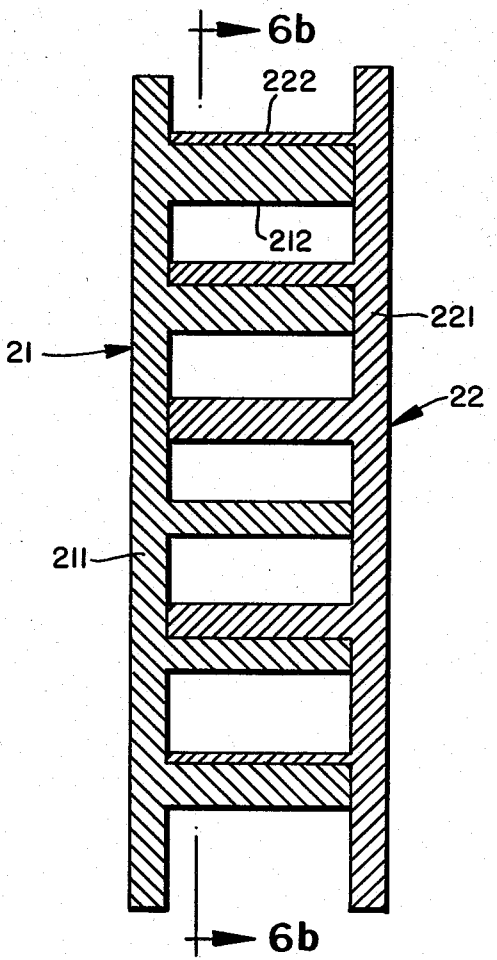

As shown in FIGS. 6(*a*) and 6(*b*), the reduction in thickness of orbiting spiral element 222 is compensated by the increase in thickness of fixed spiral element 21. As a consequence of this compensation in thickness of the fixed spiral element, orbiting scroll 22 undergoes proper orbital motion at a predetermined orbital radius.

This invention has been described in detail in connection with the above described preferred embodiment. However, the preferred embodiment is merely an example only and this invention is not restricted thereto. It will be understood by those skilled in the art that other variations and modifications can be made within the scope of this invention as defined by the appended claims.

We claim:

1. In a scroll type fluid displacement compressor including a housing having a fluid inlet port and fluid outlet port, a fixed scroll fixedly disposed within said housing and having a circular end plate from which a first wrap extends, an orbiting scroll having a circular end plate from which a second wrap extends, said first and second wraps interfitting at an angular and radial offset to make a plurality of line contacts to define at least one pair of sealed off fluid pockets, a driving mechanism operatively connected to said orbiting scroll to effect the orbital motion of said orbiting scroll and a rotation prevention device to prevent the rotation of said orbiting scroll during orbital motion so that the volume of the fluid pockets changes, the improvement comprising said second wrap of said orbiting scroll having a thickness which is gradually reduced along its entire length from the inner end portion to the outer end portion thereof to strengthen the inner portion of said second wrap without increasing the centrifugal force generated by said orbiting scroll during its orbital motion, an inner wall surface and outer wall surface of said second wrap being formed by involute curves generated from generating circles having different radii, and said first wrap of said fixed scroll having a thickness which is gradually increased along its entire length from the inner end portion of the outer end portion to compensate for the reduction in thickness of said second wrap to thereby achieve proper line contacts between said first and second wraps to improve radial sealing.

2. In a scroll type fluid displacement compressor including a housing having a fluid inlet port and fluid outlet port, a fixed scroll fixedly disposed within said housing and having a circular end plate from which a first wrap extends, an orbiting scroll having a circular end plate from which a second wrap extends, said firstd and second wraps interfitting at an angular and radial offset to make a plurality of line contacts to define at least one pair of sealed off fluid pockets, a driving mechanism operatively connected to said orbiting scroll to affect the orbital motion of said orbiting scroll and a rotation prevention device to prevent the rotation of said orbiting scroll during orbital motion so that the volume of the fluid pockets changes, the improvement comprising said second wrap of said orbiting scroll having a thickness which is gradually reduced along its entire length from the inner end portion to the outer end portion thereof to strengthen the inner end portion of said second wrap without increasing the centrifugal force generated by said orbiting scroll during its orbital motion, said first wrap of said fixed scroll having a thickness which is gradually increased along its entire length from the inner end portion to the outer end portion to compensate for the reduction and thickness of said second wrap to thereby achieve proper line contacts between said first and second wraps to improve radial sealing, and an inner wall and outer wall surface of said first wrap being formed by involute curves generated from generating circles having different radii.

* * * * *